United States Patent [19]

Lew

[11] 4,282,695

[45] Aug. 11, 1981

[54] SELF-INTERLOCKING GRILLE

[76] Inventor: Hyok S. Lew, 7890 Oak St., Arvada, Colo. 80005

[21] Appl. No.: 58,556

[22] Filed: Jul. 18, 1979

[51] Int. Cl.[3] ..... E04C 2/42

[52] U.S. Cl. ..... 52/668; 52/667; 52/664

[58] Field of Search ..... 52/664, 668, 667, 666, 52/665, 669

[56] References Cited

U.S. PATENT DOCUMENTS

| | | | |
|---|---|---|---|
| 826,989 | 7/1906 | Von Busse | 52/669 |
| 928,196 | 7/1909 | Herald | 52/669 |
| 950,236 | 2/1910 | Melish | 52/669 |
| 1,336,547 | 4/1920 | Wright | 52/669 |
| 2,069,391 | 2/1937 | Sample | 52/668 |

FOREIGN PATENT DOCUMENTS

| | | | |
|---|---|---|---|
| 317297 | of 1934 | France | 52/668 |
| 359322 | 10/1931 | United Kingdom | 52/669 |

*Primary Examiner*—James A. Leppink
*Assistant Examiner*—Henry E. Raduazo

[57] ABSTRACT

A grille comprised of a plurality of the thin strips and bars made of the steel or plastics is disclosed, which grille is assembled without using any welding or bonding. The thin strips have a series of equally spaced notches cut out along the edge of said strips, which notches are of a rectangular shape of width slightly greater than the thickness of said strip and of depth approximately equal to the one half of the width of said strip. Said strips further include a series of holes disposed intermediate each pair of adjacent notches. First half of the grille assembly is formed by the plurality of said strips forming a network wherein the notches on the strips crossing each other engage one another at each crossing point. The last half of the grille assembly is composed of bars threaded through said holes on the strips which bars forms another network wherein bars crossing each other are interlaced to one another.

2 Claims, 10 Drawing Figures

SELF-INTERLOCKING GRILLE

The grille works used for the fences, safety screens, guard rails, partitions, etc., command a high price because the grilles for such uses can not be mass produced due to varying sizes. As a consequence, most grills are custom assembled at the shop which makes the storage and the transportation of the grills ungainly and expensive.

The primary object of the present invention is to provide a grille work that can be assembled at the points of the use by the users without using special tools. Another object of the present invention is to provide a grille work of which size can be easily varied in the process of assembly.

A further object of the present invention is to provide a grille work that does not require any welding or bonding in the assembly.

Still another object of the present invention is to provide a grille work that is sturdy and strong.

Still a further object of the present invention is to provide a grille work which is inexpensive.

These and other objects of the present invention will become clear as the description and specification of the present invention proceeds. The present invention may be described with great clarity and specificity by referring to the figures showing an embodiment of the principles of the present invention.

BRIEF DESCRIPTION OF THE SEVERAL VIEWS

FIGS. 1 and 2 are front views showing two species of interlocking grills;

FIGS. 3 and 4 show strips 2, 3, 4 and 5 from FIG. 1;

Figure 1:
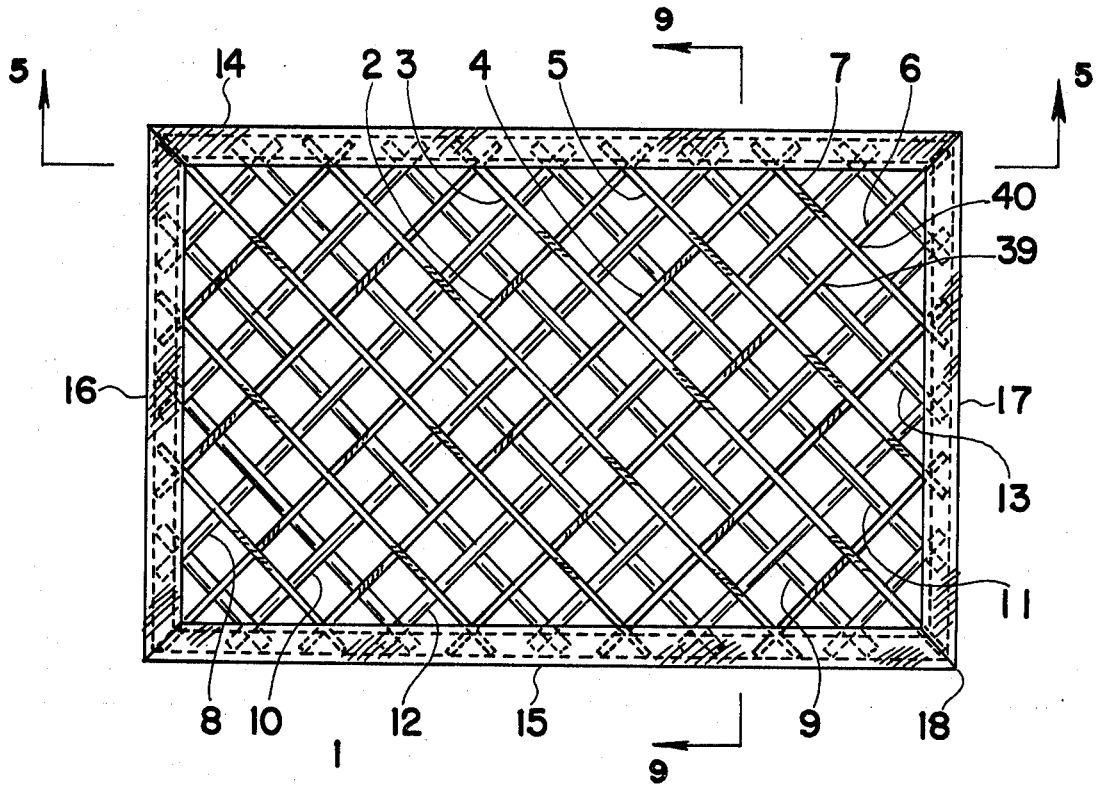
Figure 3:
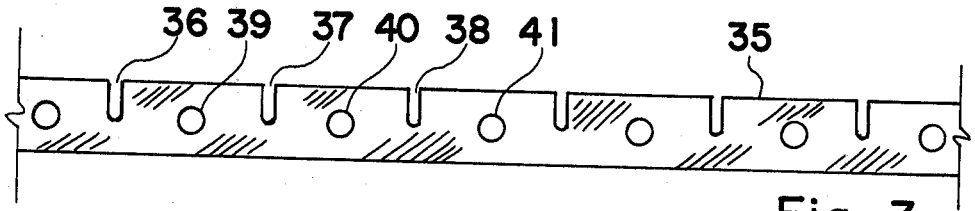
Figure 5:
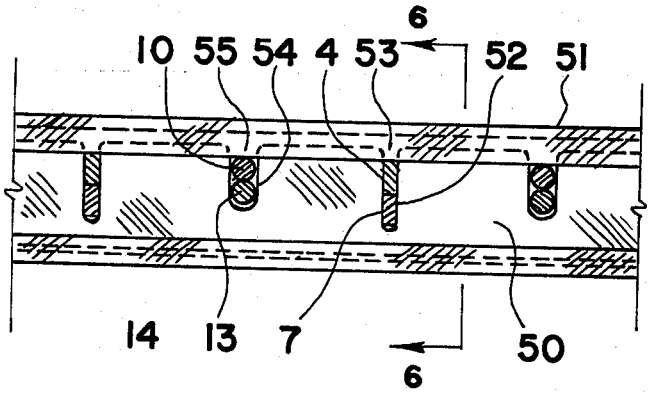
FIG. 5 shows a cross section view taken along plane 5—5 in FIG. 1.

In FIG. 1 there is shown a "self-interlocking grille" 1 constructed in accordance with the principle of the present invention. The first part of this "self-interlocking grille" 1 is composed of a plurality of strips 2, 3, 4, 5, 6, 7, etc., forming a network. These strips have the structure shown in FIG. 3, where the strip 35 shows the fundamental structure of strips 2, 3, 4, 5, 6, 7, etc. The strip 35 is a reasonably thin strip made of a metal or plastics having a series of notches 36, 37, 38, etc., disposed along one edge of the strip at generally equal distances. The width of these notches is slightly greater than the thickness of the strip and its depth is about equal to the half width of the strip. The strip 35 also includes a plurality of holes 39, 40, 41, etc., each of which is disposed at the mid-point between each pair of adjacent notches. Returning to FIG. 1, the plurality of the strips 2, 4, 6 etc. which has the structure of the strip 35 in FIG. 5 are lined up in one direction in parallel configuration. The plurality of the strips 3, 5, 7 etc. of structures of strip 35 are lined up in other direction in parallel configuration. The first group of strips and the second group of strips are disposed in such a way that the notches on the strips of the first group engages the notches on the strips of the second group in forming a network. Therefore, at each of the intersection points where two strips cross as represented by the point 40, the pair of notches belonging to the pair of the crossing strips engages each other and thus, prevents said pair of strips from sliding movement relative to each other on the plane of the grille work, though they can be separated from each other in the direction perpendicular to the plane of the grille. Such a separation is prevented by the second part of the structure, which is the mesh work composed of bars 8, 9, 10, 11, 12, 13, etc. The bars 8, 10, 12 etc., lined up in one direction are threaded through the holes on strips 3, 5, 7, etc., lined up in the other direction. The bars 9, 11, 13, etc., lined up in the other direction are threaded through the holes on the strips 2, 4, 6 etc., lined up on one direction as shown by the crossing 39. Here, it should be noticed that the groups of bars lined up in two different directions are interlaced forming a woven mesh, which maintains the structure of the "self-interlocking grille" rigid and permanent. Said grille work is framed by the frame structure composed of members 14, 15, 16 and 17. These members may be welded or bonded or screwed to each other at the joint represented by joint 18. The frame may be connected to the grille work removably or permanently as shown in FIGS. 5, 6, 7, 8, 9 and 10 which is to be explained later.

There is shown another "self-interlocking grille" constructed in accordance with the teaching of the present invention. This grille work comprised of the first network including strips 20, 21, 22, 23, 24, etc., and the second network including bars 25, 26, 27, 28, 29, 30, etc., are constructed in a manner quite similar to the grille work shown in FIG. 1 apart from the fact that the groups of the strips are interlaced to each other as well as the bars. The interlacing of the strips is made possible by using the structure of the strip 42 shown in FIG. 4. Here, the strip 42 has a series of notches 43, 44, 45, 46, etc. which are disposed on two edges of the strip 42 in alternating pattern. The holes 47, 48, 49, etc., receiving the bars are disposed along the center line of the strip 42. The grille work comprising strips 20, 21, 22, 23, 24, etc., and bars 25, 26, 27, 28, 29 and 30 are framed by a frame comprising members 31, 32, 33 and 34. The various means shown in FIGS. 5, 6, 7, 8, 9 and 10 can be used to fasten the grille work to the frame. Here, it is noticed that the grille work is arranged in the right angle to the frame in FIG. 2 while that of FIG. 1 employs the oblique angle. It should be understood the grille work structures shown in FIGS. 1 or 2 can be used for either the right or oblique angle framing.

Figure 6:
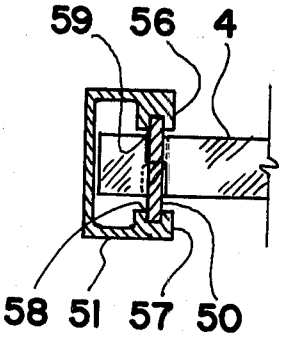
FIG. 6 is a section taken on line 6—6 of FIG. 5.

In FIGS. 5 and 6, there is shown a cross section view taken along plane 5 5 as shown FIG. 1, which shows one method of fastening the grille work to the frame, which fastening method is particularly suitable for the oblique angle framing. The framing member 14 as well as 15, 16 and 17, is comprised of a fastening strip 50 and a framing channel 51. The fastening strip 50 has a series of narrow notches 52 with opening 53 and a series of wide notches 54 with opening 55 disposed along one edge of said fastening strip wherein said two notches are disposed in alternating pattern. The narrow notch 52 receives the strip 4 and 7 at their intersection and the wide notch 55 receives the bar 10 and 13 at their intersection. Of course, the two groups of notches can be spaced in such a way that they receive the strips and bars at points other than their intersection. The framing channel 51 has a pair of flanges 56 and 57 having grooves 58 and 59, respectively, which pair of grooves are dimensioned to receive and retain the fastening strip 50 by a snapping motion or sliding motion. It is obvious that, with the frame shown in FIGS. 5 and 6, the entire grille work shown in FIG. 1 can be assembled without using any welding or bonding.

Figure 2:
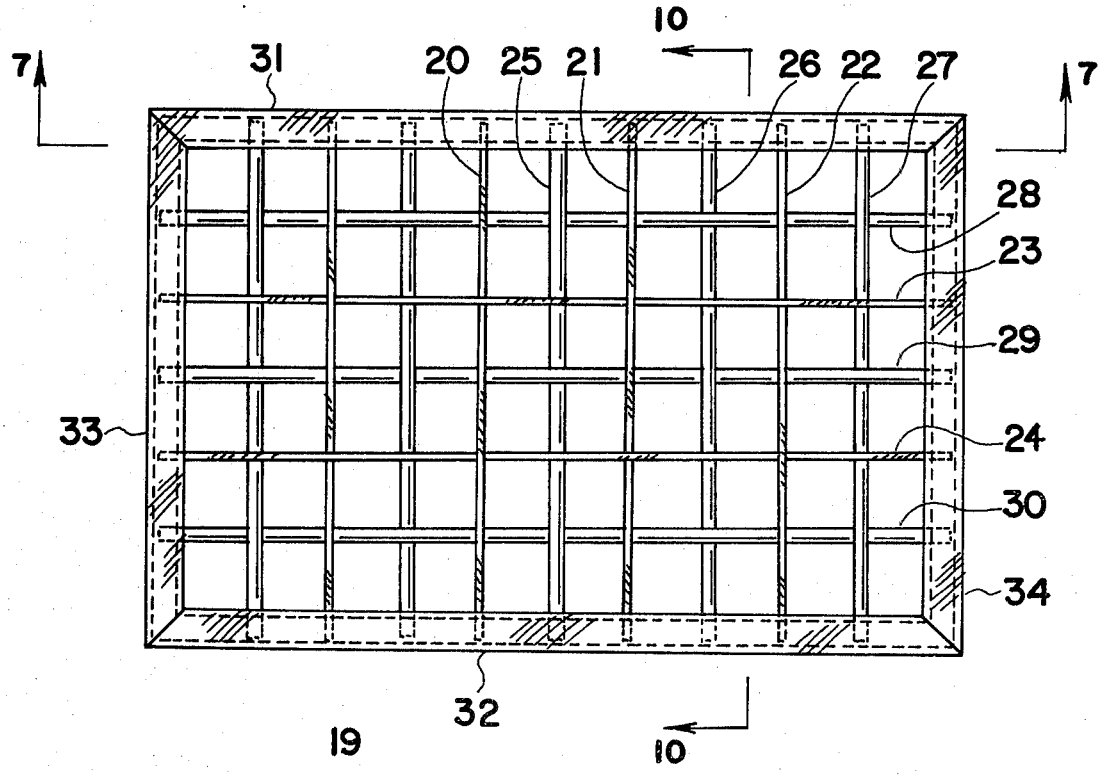
Figure 4:
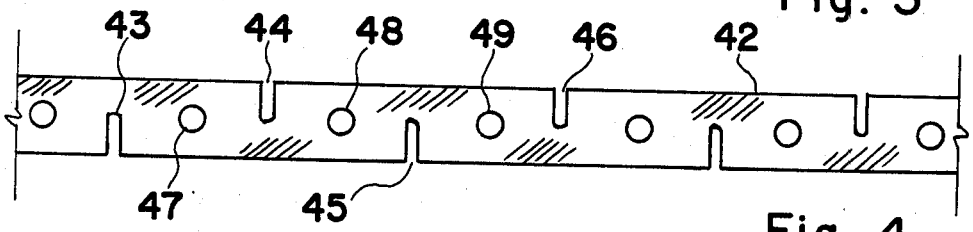
Figure 7:
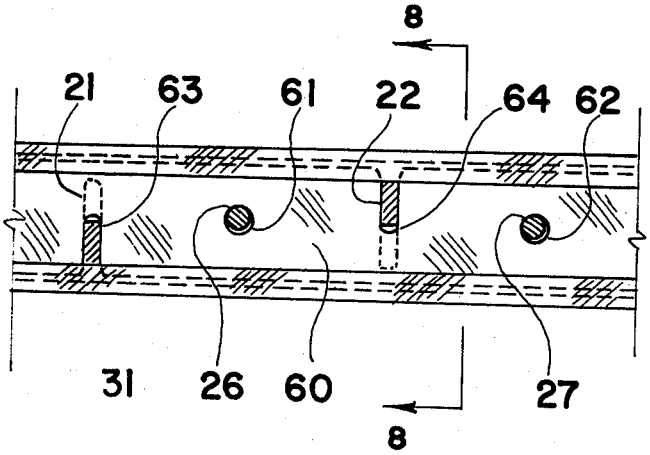
FIG. 7 is a cross section taken on line 7—7 of FIG. 2.
Figure 8:
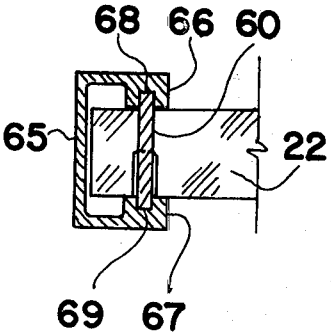
FIG. 8 is a cross section taken on line 8—8 of FIG. 7.

In FIGS. 7 and 8, there is shown another method of fastening the grille work to the frame without using any welding or bonding, which figures shows a cross section view taken along the plane 7—7 as shown in FIG. 2. The frame 31 as well as 32, 33 and 34 is composed of the fastening strip 60 having notches 63, 64, etc., and holes 61, 62 etc., which strip is essentially the same strip as those forming the grille work that is shown in FIG. 4, and the framing channel 65 having a pair of flanges 66 and 67 with a pair of grooves 68 and 69 dimensioned to receive and retain the fastening strip 60 by snapping motion or sliding motion. This method of fastening the grille work to the frame is particularly suited for the right angle framing.

Figure 9:
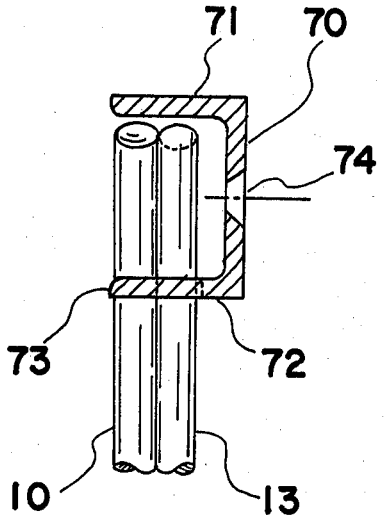
FIG. 9 is a cross section taken on line 9—9 of FIG. 1.

In FIG. 9, there is shown further method of fastening the grille work to the frame, which is ideal for mounting the grille work to the existing frame such as the case of the safety grille on the windows. Here, another cross sectional view taken along plane 9—9 as shown FIG. 1 is illustrated. The notches similar to those disposed on the fastening strip 50 shown in FIG. 5 are disposed on one flange 72 of the channel 70 with opening disposed on the edge 73 of that flange. These notches receive the strips and bars constituting the grille work. The channel 70 has a plurality of holes 74 disposed on the web of the channel for screw connecting the frame to the existing window frame.

Figure 10:
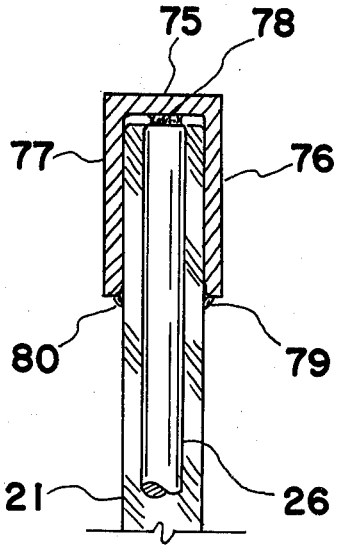
FIG. 10 is a cross section taken on line 10—10 of FIG. 2.

The grille work may be permanently connected to the frame by welding or bonding as shown in FIG. 10, which shows a cross section view taken along the plane 10—10 as shown in FIG. 2. The cavity of the channel 75 with the flanges 76 and 77 receives the strips and bars constituting the grille works which are welded to the channel 75 by welds 78, 79, 80 etc.

I claim:

1. A self-interlocking grille comprising:

(a) a first group of strips having a plurality of notches cut out along one edge of said strips at equal distance and a plurality of holes disposed on said strips in such a way that each of said holes is disposed at the mid-point between each of the adjacent pair of said notches, said strips of said first group of strips being arranged in a parallel configuration in a first direction;

(b) a second group of strips having a plurality of notches cut out along one edge of said strips at equal distance and a plurality of holes disposed on said strips in such a way that each of said holes is disposed at the mid-point between each of the adjacent pairs of said notches, said strips of said second group of strips being arranged in a parallel configuration in a second direction transverse to said first direction, wherein each of said notches disposed on said strips of said second group of strips engages each of said notches disposed on said strips of said first group of strips in crossing each other and, thus forming a network;

(c) a first group of bars arranged in a parallel configuration in said first direction, each of bars of said first group of bars disposed intermediate each of the adjacent pairs of strips of said first group of strips and threaded through said holes on the strips of said second group of strips; and (d) a second group of bars arranged in a parallel configuration in said second direction, each of the bars of said second group of bars disposed intermediate each of the adjacent pairs of strips of said second group of strips and threaded through said holes disposed on the strips of said first group of strips, wherein said bars of said second group of bars interlace said bars of said first group of bars.

2. A self-interlocking grille comprising:

(a) a first group of strips having a plurality of notches cut out along both edges of said strips in alternating fashion at equal distance and a plurality of holes disposed on said strips in such a way that each of said holes is disposed at the mid-point between each of the adjacent pairs of said notches, said strip of said first group of strips being arranged in a parallel configuration in a first direction;

(b) a second group of strips having a plurality of notches cut out along both edges of said strips in alternating fashion at equal distance and a plurality of holes disposed on said strips in such a way that each of said holes is disposed at the mid-point between each of the adjacent pairs of said notches, said strips of said second group of strips being arranged in a parallel configuration in a second direction transverse to said first direction, wherein each of said notches disposed on said strips of said second group of strips engages each of said notches disposed on said strips of said first group of strips in crossing each other and, thus, forming a network in the interlacing pattern;

(c) a first group of bars arranged in a parallel configuration in said first direction, each of the bars of said first group of bars disposed intermediate each of the adjacent pairs of strips of said first group of strips and threaded through said holes disposed on the strips of said second group of strips; and (d) a second group of bars arranged in a parallel configuration in said second direction, each of the bars of said second group of bars disposed intermediate each of the adjacent pairs of the strips of said second group of strips and threaded through said holes disposed on the strips of said first group of strips, wherein said bars of said second group of bars interlace said bars of said first group of bars.

* * * * *